United States Patent [19]

Sasaki et al.

[11] 3,972,435

[45] Aug. 3, 1976

[54] SAFETY GLASS CONTAINER

[75] Inventors: Takashi Sasaki, Kawanishi; Masayuki Watanabe, Amagasaki, both of Japan

[73] Assignee: Yamamura Glass Kabushiki Kaisha, Japan

[22] Filed: Jan. 7, 1975

[21] Appl. No.: 539,226

[30] Foreign Application Priority Data

Oct. 23, 1974 Japan ..... 49-121508

[52] U.S. Cl. ..... 215/12 R; 215/31

[51] Int. Cl.[2] ..... B65D 23/08

[58] Field of Search ..... 215/12 R

[56] References Cited

UNITED STATES PATENTS

| | | | |
|---|---|---|---|
| 1,759,176 | 5/1930 | Voorhees | 215/12 R |
| 2,103,679 | 12/1937 | Kline | 215/12 R X |
| 3,331,521 | 7/1967 | Paige | 215/12 R X |
| 3,604,584 | 9/1971 | Shank | 215/12 R |
| 3,698,586 | 10/1972 | Terner | 215/12 R |
| 3,744,658 | 7/1973 | Fujio | 215/12 R X |

*Primary Examiner*—Donald F. Norton

*Attorney, Agent, or Firm*—Wenderoth, Lind & Ponack

[57] ABSTRACT

The safety glass container or bottle comprises in combination an elongated cylindrical hollow glass body strengthened chemically by the ion exchange method, a pair of protective cushioning materials consisting of a thermoplastic resin and being provided to encircle the shoulder portion and bottom portion of the glass body and a protective film sheath formed from a heat shrinkable material to encircle the glass body and cushioning materials.

17 Claims, 9 Drawing Figures

(a) groove area (b) aventurine area

SAFETY GLASS CONTAINER

BACKGROUND OF THE INVENTION

This invention relates to a safety glass container and more particularly, it is concerned with a strengthened safety glass container, for example, glass bottle having a high breaking strength.

Of late, synthetic resins have entered into the field of glass wares because of their having an excellent workability, a great variety of color tones and a light weight, but glass wares have still been used widely since glass is much more excellent in heat resistance and chemical resistance than plastics. However, since glass has a large weight and is often subject to breakage through even a small shock, various studies have hitherto been made so as to increase the strength of the glass.

In an example, the mechanical strength of glass is chemically increased by the so-called ion exchange method wherein an ion A contained in glass is replaced by an ion B having a larger radius. This chemical strengthening called "ion exchange method" is carried out by the spraying method as mentioned in Japanese Patent Publication No. 28674/1965 (Corning Co.), Japanese Patent Publication No. 6610/1973 (Owens Illinois Inc.) and Japanese Patent Publication No. 1316/1972 (Blockway Co.) or by the dipping method as mentioned in British Patent 917,388 (Research Corp.) and British Patent 1,010,164 (Pittsburgh Plate Glass Co.). The tensile strength of a glass container is very high, but markedly lowers if the surface is slightly scratched or abrased. Therefore, it has been proposed to protect a glass container from chances of abrasion or surface scratches by applying to the glass surface a coating of a metal oxide (Japanese Patent Publication No. 11598/1967), a polymer coating (Japanese Patent Publication No. 20716/1967) or a dual coating (Japanese Patent Publication No. 1758/1967). Furthermore, in Japanese Patent Publication No. 1307/1972 is also disclosed a method of strengthening glass, wherein a glass article is subjected to coating of a metal oxide, chemical strengthening treatment by ion exchanging and polymer coating. However, this method cannot be put to practical use in view of the complexity of the steps thereof and has another disadvantage. That is to say, the olefin polymer coating obtained by the use of an aqueous emulsion of olefin polymer as disclosed in the above mentioned specification is almost stripped in the washing step when a glass container is recovered and reused and during the same time, the surface of the glass container tends to be scratched. When reusing it, therefore, an olefin polymer coating should be formed and, as an inevitable consequence, the number of repetition thereof decreases. It has thus been desired to form a permanent resin coating such as not to be stripped in the washing step when a glass containeer is recovered and reused.

Previous attempts to protect glass articles or glass bottles from breakage are not satisfactory, such as to use a bottle shield of rubber for shock absorbing (U.S. Pat. No. 2,706,571), to encircle the outermost surfaces of a glass bottle with rings of enamel or paper (U.S. Pat. No. 3,331,521), to encircle a bottle of thermoplastic material with a band of polyvinyl chloride in order to raise the bursting strength (U.S. Pat. No. 3,542,229), to encase the bottom and shoulder of a glass bottle in a heat-shrinkable plastic cup and cover the central portion with a polyethylene film (U.S. Pat. No. 3,698,586) and to protect a glass article by encircling with a heat-shrinkable polyvinyl chloride film (U.S. Pat. No. 3,604,584). These proposals however aim at preventing glass articles or glass bottles from scratching in handling or shipment and reducing the breakage due to scratching as little as possible. Therefore, the strength of a glass bottle can be held as it is, but cannot be raised.

BRIEF SUMMARY OF THE INVENTION

It is an object of the invention to provide a safety glass container, whereby the above mentioned disadvantages of the prior art are overcome.

It is another object of the invention to provide a strengthened safety glass container which is subjected to a chemical strengthening treatment and plastic protection in combination.

The above mentioned objects can be accomplished by a safety glass container comprising in combination an elongated cylindrical hollow glass body strengthened chemically by the ion exchange method, a pair of protective cushioning materials consisting of a thermoplastic resin and being provided to encircle the shoulder and bottom of the glass body and a protective sheath formed from a heat-shrinkable material to encircle the glass body and cushioning materials.

BRIEF DESCRIPTION OF THE DRAWINGS

FIG. 3 (*b*) shows a further modification wherein the cushioning material is fitted to an aventurine area.

FIG. 4 (*b*) shows a further modification wherein a grooved area is provided on the neck portion.

DETAILED DESCRIPTION OF THE INVENTION

Figure 1:
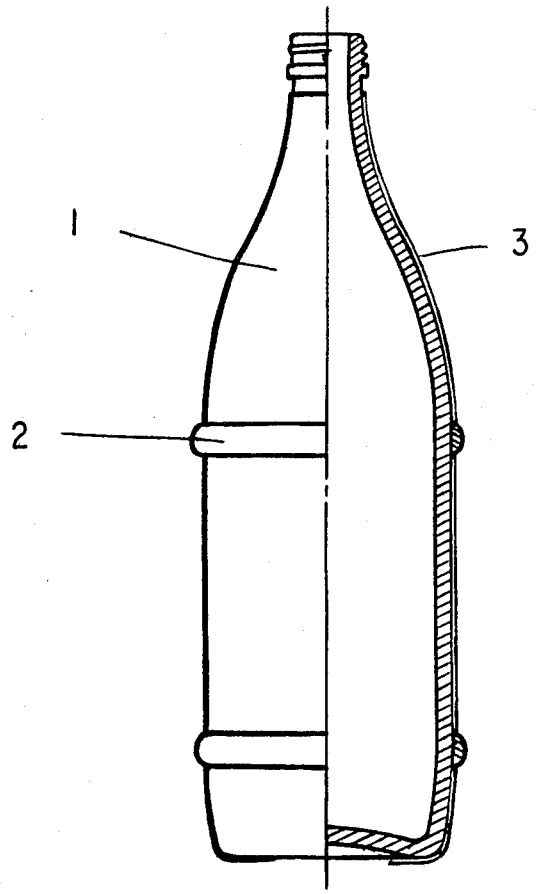
FIG. 1 relates to a safety glass container which comprises a glass bottle (1) strengthened chemically by the ion exchange method, a pair of protective cushioning materials (2) consisting of a thermoplastic resin encircling the shoulder and bottom portion of the glass body and a protective sheath (3) formed from a heat-shrinkable material encircling the glass body and cushioning materials.
Figure 2:
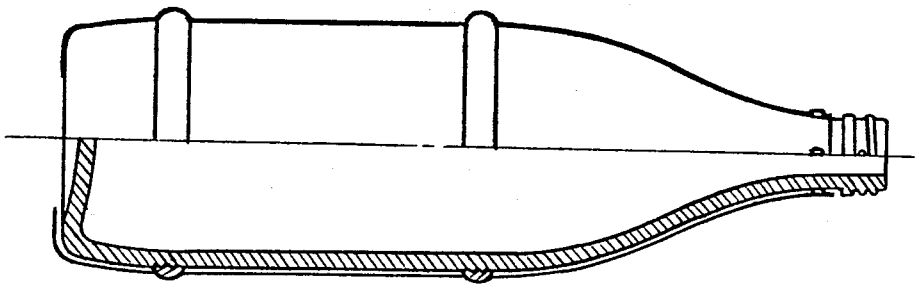
FIG. 2 is a modification of FIG. 1 wherein the neck portion of the bottle has a rugged or aventurine area thereupon.
Figure 3:
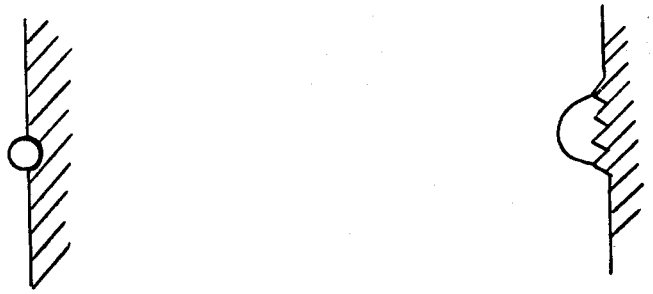
FIG. 3 (*a*) shows a modification wherein the cushioning material is fitted to a groove.
Figure 4:
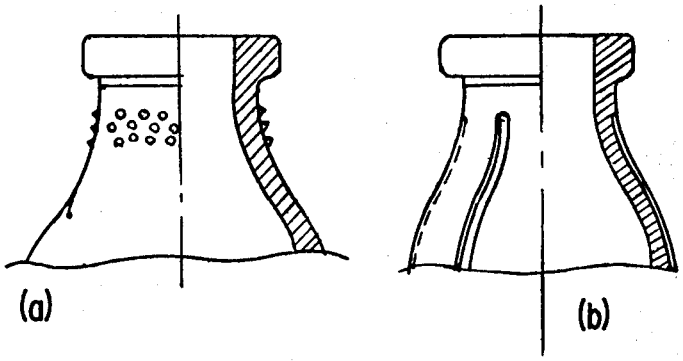
FIG. 4 (*a*) shows a further modification wherein an aventurine area is provided on the neck portion to form a small gap between the surface of the bottle and shrunk film.
Figure 5:
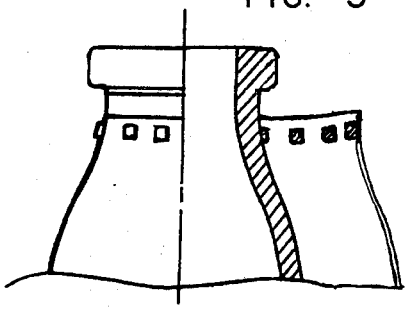
FIG. 5 shows a modification wherein a rugged area is provided on the inner surface of the film on the upper end of the film.
Figure 7:
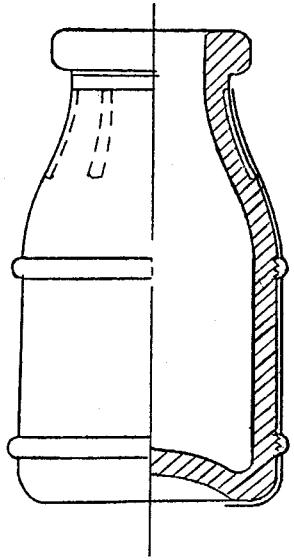
FIG. 7 is a schematic view of a glass bottle according to the present invention wherein a grooved area is provided on the neck portion of the bottle.
Figure 6:
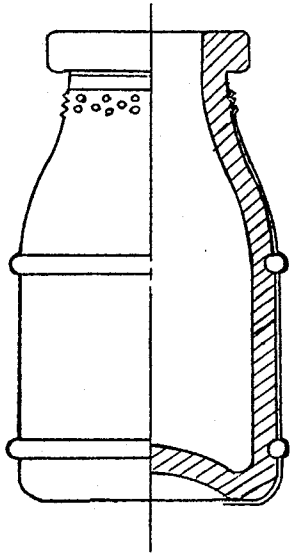
FIG. 6 is a schematic view of a glass bottle of the present invention wherein the neck portion of the bottle has an aventurine area thereupon.

In accordance with the present invention, the outer surface of a glass container, in particular, glass bottle is subjected to a chemical treatment well-known per se in the art as "ion exchange method" so as to increase the mechanical strength thereof and encircled by a pair of narrow elastic rings of thermoplastic resin at the shoulder portion and bottom portion of the bottle and further by a protective film sheath formed from a heat-shrinkable material and heat-shrunk into contact with a major portion of the side wall and at least a minor portion of the bottom wall, including the narrow elastic rings, whereby the outer surface of the bottle is protected from scratching, the strength raised by the ion exchange method is preserved and the resistance to shock is raised.

The chemical strengthening treatment by ion exchange in the present invention is a chemical treatment wherein an ion A in glass surface is replaced by an ion B having a larger radius than the ion A. That is to say, sodium ions in glass surface are replaced by other metal ions by applying to the outer surface of a glass container at a high temperature sulfates, nitrates, phosphates and halides of potassium, cesium, silver, thallium, etc. individually or in combination to thus give a compressive stress ranging from 1,000 to 5,500 Kg/cm$^2$ to the outer surface depending on the glass composition and to resist the tensile stress during breakage. Application of these salts to the outer surface of a glass container is preferably carried out by spraying a solution of salt followed by heating or by dipping in a solution of salt heated at a high temperature.

In the present invention, a pair of protective cushioning materials or rings of thermoplastic resin are used for the purpose of protecting the outer surface of a glass container from scratching or shocking. For example, a commercially sold monofilament of synthetic thermoplastic resin is provided to the outer surface of a glass container, preferably, by fitting or bonding on the shoulder portion and bottom portion thereof with or without adhesives. In addition, it is also possible to heat and melt a resin, extrude in an annular form and apply to a glass bottle revolving. Examples of the commercially sold monofilament are low pressure process polyethylene, high pressure process polyethylene, polypropylene, polyvinyl chloride, nylon and rubber monofilaments. The low pressure process polyethylene and nylon have a problem that, because of their low elasticity or softness, the monofilament tends to slip if the diameter is somewhat larger than that of a glass bottle and is hard to be fit if smaller, but, on the other hand, the high pressure process polyethylene is so excellent in elasticity and softness that the monofilament is readily fitted and is also excellent in shock strength. Therefore, this is the most preferable resin for the practice of the invention. If the area on which such a ring is provided is formed in a grooved or aventurine form in this case, the fitting or bonding effect of the ring is better. Where a resin is heated, melted and applied to a glass bottle, the use of a suitable coating means and ordinary screen printing machine in combination is preferable since the hot melt can be applied sanitarily with a high efficiency. Examples of the resin used in this case are as follows:

1. Polyolefin resin compositions comprising a polyolefin resin, as a main component, and additives such as wax, tackifier, plasticizer and antioxidant.

2. Acrylic resin compositions comprising an acrylic resin, as a main component, and additives as mentioned above.

3. Polyamide resin compositions comprising a polyamide resin, as a main component, and additives as mentioned above.

4. Rubber resin compositions comprising a rubber, as a main component, and additives as mentioned above.

The effects of these additives are as follows:

1. Wax

Lowering of the melt viscosity of a resin and improvement of the workability

2. Tackifier

Lowering of the melt viscosity of a resin to improve the tackiness (wetting) in melting and coating the resin and to improve the workability 3. Plasticizer Raising of the softness of a resin, lowering of the melt viscosity, improvement of the wetting property, raising of the adhesive force and improvement of the shock resistance and stripping resistance 4. Antioxidant Prevention of the rising of the melt viscosity by oxidation and decomposition of a resin, prevention of the coloring and the decrease of the adhesive force and improvement of the durability These additives can be blended selectively or optionally depending on the purpose.

As the protective sheath of the invention there may be used heat-shrinkable films, preferably, monoaxially stretched films having a shrinking percentage of 50% or more, in particular, in the case of a cylindrical or conical glass container such as glass bottle. The larger is the shrinking percentage, the better. At the present time, vinyl chloride resins are primarily sold as the monoaxially stretched film and polyethylene and polypropylene films have scarcely been put to practical use because of their small shrinking percentage. If the thickness of a heat-shrinkable film is too small, the film tends to break through friction and cannot protect a glass bottle from scratching, while, if too thick, the central portion between the neck and bottom of a glass bottle is protected in excess and, when the glass bottle is broken, the neck portion and bottom portion are vigorously burst and glass fragments are scattered. This is dangerous. Therefore, when a glass bottle is broken, it is rather necessary to release the gas in the glass bottle through tears formed by the breakage of the film in order to prevent the bursting and scattering as far as possible. From this point of view, the inventors have made various studies and found that the film thickness is preferably 0.05 to 0.1 mm and, in particular, the optimum thickness is about 0.072 mm. As occasion demands, a rugged area is provided on the inner surface of the film or a rugged area, aventurine area or intermittent adhesive layers like stepping stones are provided on or near the neck portion and/or bottom portion of a glass bottle to form a gap between the surface of the bottle and shrunk film so that the bursting during breakage may be moderated. Since a shrinkable film having a desired print can be used, furthermore, a printing step can be omitted and, if a shrinkable film containing an ultraviolet absorbent is used, the content in a glass bottle can be protected.

The above mentioned heat-shrinkable film encircles a glass bottle in contact with a major portion of the side wall and at lease a minor portion of the bottom wall, preferably from a position somewhat above the boundary between the neck and shoulder to the bearing portion of the bottom.

The following examples are given in order to illustrate the invention in detail without limiting the same.

EXAMPLE 1

The present invention was applied to a soda-lime-silica glass container (1000 ml juice bottle) having a theoretical composition of, as oxides, $SiO_2$ 71.5, $Al_2O_3$ 1.25, CaO 10.2, MgO 2.5, $Na_2O$ 13.5 and $K_2O$ 0.02% by weight. This glass container was preheated for 30–40 minutes in a drier at 150°–200°C, taken out of the drier and then subjected to spraying of a 30% aqueous solution of potassium nitrate in such a manner that the outer surface of the glass container was uniformly wetted. The glass container was then charged in an electric furnace, heated and held at a temperature of 500° ± 10°C for 2 hours. The glass container was taken, cooled gradually, washed to remove the potassium nitrate from the outer surface and dried. Rings (2 m/m $\phi$) of high pressure process polyethylene were fitted to two positions, i.e., the shoulder portion and bottom portion to be scratched readily of the thus strengthened bottle. Then a heat-shrinkable film of polyvinyl chloride having a thickness of 0.072 mm and shrinking percentage of 55% was covered over the ring-fitted glass container, charged and held for about 3 seconds in a drier adjusted at 150° C and heat shrunk and contacted tightly with the outer surface of the glass container.

Furthermore, the following four glass bottles were prepared for comparison:

1. Standard bottle free from the above mentioned chemical strengthening treatment and having no cushioning rings and heat-shrunk film as mentioned above
2. Bottle free from the above mentioned chemical strengthening treatment but having the above mentioned cushioning rings and heat-shrunk film
3. Bottle subjected to the above mentioned chemical strengthing treatment but having no cushioning rings and heat-shrunk film as mentioned above
4. Bottle subjected to the above mentioned chemical strengthening treatment and having the above mentioned heat-shrunk film For each of the above mentioned five glass bottles, a test bottle under non-scratched state and another test bottle subjected to Line Simulator manufactured by American Glass Research Co. for 30 minutes corresponding to 30 runs in the market, assuming the maximum scratches to be suffered in the recovering stage, were respectively prepared and subjected to the following strength tests:

I. Pressure resisting strength test

A pressure resisting strength testing device (manufactured by A. G. R. Co.) was used.

A test bottle filled with water is set and covered to prevent scattering and a start bottom is pressed. A hydraulic pressure is automatically applied to the inside of the bottle, which is indicated by a pressure gauge. The level of the hydraulic pressure was raised every 3 seconds. The pressure in the case of holding the test bottle under this pressure for 1 minute is indicated on the upper and right portion of the device. When the hydraulic pressure is stepwise raised and the test bottle is broken at a certain pressure level, an indication of one step lower than this pressure level is recorded as "pressure resisting strength" of test bottle.

II. Shock strength test

A ball shock strength testing device was used.

The height of a sample supporting base is so adjusted that a shocking head beats a predetermined position (cushioning ring) and a test bottle is set. The head is supported by a lock means and a handle for moving a scale plate is revolved to set the initial shocking angle. The test bottle is mounted on the supporting base and the top of the bottle is lightly held. Then the lock means of the head is released and the bottle is beaten. After the first beating, the bottle is somewhat revolved to shift the beating position in circumferential direction and the second beating is carried out. Beating is repeatedly carried out while the angle of arm is gradually enlarged and the bottle is shifted every angle in circumferential direction and, when the test bottle is broken, the angle is recorded as a shock energy using an angle-shock energy conversion table.

III. Thermal shock test

A thermal shock testing device according to ASTM was used.

The temperature of a cold water tank is first adjusted to 15°C and that of a warm water tank is adjusted to 60°c, the temperature difference being 45°C. A test bottle is charged in a basket. Switching on, the basket is first dipped in the warm water tank and held for 5 minutes as it is. Then the basket is removed into the cold water tank and dipped therein for 1 minute. The basket was taken out of the cold water tank and the number of broken bottles are counted. Thereafter, the temperature of the warm water tank is stepwise raised to adjust the temperature difference to 55°C, 65°C and 75°C and every temperature difference, the above mentioned procedures are repeated.

Results of these three kinds of the strength tests are shown in Table 1.

EXAMPLE 2

A glass container (light weight, 1000 ml) having the same theoretical composition to that of Example 1 was preheated at about 460°C, dipped in a potassium nitrate solution tank kept substantially at the same temperature as that of the glass container for about 10 minutes, withdrawn, cooled gradually in a gradual cooling furnace, washed to remove the potassium nitrate from the outer surface of the container and dried to obtain a chemically strengthened bottle.

A resin composition comprising 50% of an ethylene binyl acetate resin having a melt index of 2 to 300, a molecular weight of about 20,000 and a vinyl acetate content of 15–30%, 20% of wax, 29% of a tackifier and 1% of an antioxidant was heated and melted to give a hot melt. The resulting hot melt was extruded and applied to the shoulder portion and bottom portion of the strengthened glass container to form a ring having a semicircular cross section of 2 mm $\phi$ in radius. Then the glass container was further covered with a heat-shrinkable film of polyvinyl chloride having a thickness of 0.072 mm and a shrinking percentage of 55%, charged and held in a drier held at 150°C for about 3 seconds and heat-shrunk and the film was thus contacted tightly with the glass container. The other procedures and testing methods were carried out in an analogous manner to Example 1. The results are shown in Table 2.

EXAMPLE 3

A soda-lime-silica glass container (light weight, 1000 ml) having the same composition as that of Example 1 was preheated in a drier at 150°–200°C for 30–40 minutes, withdrawn and then subjected to a uniform spraying of a solution of potassium phosphate heated. The thus wetted glass container was heated in an electric furnace and held at 490° ± 10°C for 1 hour. This container was taken out of the electric furnace, cooled gradually, washed to remove the potassium phosphate from the outer surface and dried to obtain a strengthened container. The other procedures and testing methods were carried out in an analogous manner to Example 1. The results are shown in Table 3.

Table 1

Test Results (Example 1)

| Sample | LS** (min) | Pressure Resisting Strength (psi) | Shock Strength (Kg.cm) | Heat Resisting*** Strength |
|---|---|---|---|---|
| Test Bottle (1) | 0 | 253 (100) | 11.4 (100) | 76 |
| Standard | 30 | 140 ( 55%) | 3.7 ( 32%) | 70 |
| Test Bottle (2) | 0 | 275 (108%) | 60 (526%) | 85 or more |
| R* + F* | 30 | 225 ( 88%) | 55 (482%) | 80 |
| Test Bottle (3) | 0 | 350 (138%) | 16.5 (144%) | 85 or more |
| C/T* | 30 | 150 ( 63%) | 5.7 ( 50%) | 70 |
| Test Bottle (4) | 0 | 350 (138%) | 16.8 (147%) | 85 or more |
| C/T + F | 30 | 320 (126%) | 15.0 (132%) | 85 |
| Test Bottle (5) | 0 | 350 (138%) | 65 or more (570%) | 85 or more |
| C/T + R + F (Our Invention) | 30 | 350 (138%) | 65 or more (570%) | 85 or more |

Note: *R = cushioning ring
F = heat-shrunk film
C/T = chemical strengthening treatment
**LS = treating time (min) by means of Line Simulator
***Heat Resisting Strength = temperature difference (°C) when 50 % of bottles are broken
The numerals in the parentheses of Pressure Resisting Strength and Shock Strength mean percentages when those of Standard Bottle are regarded as 100.

Table 2

Test Results (Example 2)

| Sample | LS (min) | Pressure Resisting Strength (psi) | Shock Strength (kg.cm) | Heat Resisting Strength |
|---|---|---|---|---|
| Test Bottle (1) | 0 | 253 (100) | 11.4 (100) | 76 |
| Standard | 30 | 140 ( 55%) | 3.7 ( 32%) | 70 |
| Test Bottle (2) | 0 | 275 (108%) | 58 (508%) | 85 |
| R + F | 30 | 225 ( 88%) | 55 (482%) | 80 |
| Test Bottle (3) | 0 | 335 (132%) | 15.0 (131%) | 85 or more |
| C/T | 30 | 150 (60 %) | 5.0 ( 44%) | 70 |
| Test Bottle (4) | 0 | 340 (134%) | 16.5 (144%) | 85 or more |
| C/T + F | 30 | 320 (126%) | 15.0 (131%) | 85 |
| Test Bottle (5) | 0 | 340 (134%) | 65 or more (570%) | 85 or more |
| C/T + R + F (Our Invention) | 30 | 340 (134%) | 65 or more (570%) | 85 or more |

Table 3

Test Results (Example 3)

| Sample | LS (min) | Pressure Resisting Strength (psi) | Shock Strength (kg.cm) | Heat Resisting Strength |
|---|---|---|---|---|
| Test Bottle (1) | 0 | 253 (100) | 11.4 (100) | 76 |
| Standard | 30 | 140 ( 55%) | 3.7 ( 32%) | 70 |
| Test Bottle (2) | 0 | 275 (108%) | 60 (526%) | 85 or more |
| R + F | 30 | 225 ( 88%) | 55 (482%) | 80 |
| Test Bottle (3) | 0 | 368 (145%) | 17.0 (149%) | 85 or more |
| C/T | 30 | 165 ( 65%) | 5.5 ( 48%) | 80 |
| Test Bottle (4) | 0 | 370 (146%) | 17.5 (153%) | 85 or more |
| C/T + F | 30 | 340 (134%) | 16.1 (141%) | 85 or more |
| Test Bottle (5) | 0 | 380 (150%) | 65 or more (570%) | 85 or more |
| C/T + R + F (Our Invention) | 30 | 375 (148%) | 65 or more (570%) | 85 or more |

As is evident from the results shown in Table 1 to Table 3, the safety glass bottle of the invention, that is, "C/T + R + F" treated glass bottle is more excellent in Pressure Resisting Strength, Shock Strength and Heat Resisting Strength and, in particular, shows a marked advantage that the strengths hardly lower even after LS treatment for 30 minutes. Since the outer surface of a chemically strengthened glass bottle is fitted with cushioning rings and further encased in a heat-shrunk film according to the present invention, frictions and scratches suffered during various handlings can be absorbed and the strength of the strengthened bottle can be preserved as it is, thus preventing sufficiently lowering of the strength due to scratching. As to shocks, in particular, a shock energy of 50 Kg.cm or more can be absorbed by the cushioning effect of the ring and the shock strength can markedly be raised. The pressure resisting strength and shock strength are unexpectedly raised by the use of "C/T" treatment and "R + F" treatment in combination more than using such treatments individually. Apparently this is the so-called synergistic effect.

What is claimed is:

1. A safety glass container comprising in combination an elongated cylindrical hollow glass body strengthened chemically by the ion exchange method, a pair of protective cushioning materials consisting of a thermoplastic resin and encircling the shoulder portion and bottom portion of the glass body and a protective film sheath formed from a heat-shrinkable material encircling the glass body and cushioning materials.

2. The safety glass container of claim 1, wherein said thermoplastic resin is selected from the group consisting of polyolefin resins, polyamide resins, vinyl chloride resins, acrylic resins and rubbers.

3. The safety glass container of claim 2, wherein said polyolefin resin is a member selected from the group consisting of a low pressure process polyethylene, high pressure process polyethylene and polypropylene.

4. The safety glass container of claim 2, wherein said polyamide resin is nylon.

5. The safety glass container of claim 2, wherein said vinyl chloride resin is polyvinyl chloride.

6. The safety glass container of claim 1, wherein said cushioning materials are formed by applying a hot melt of thermoplastic resin to form rings.

7. The safety glass container of claim 6, wherein said thermoplastic resin is selected from polyolefin resins, acrylic resins, polyamide resins and rubber resins.

8. The safety glass container of claim 1, wherein said heat-shrinkable material is selected from the group consisting of polyvinyl chloride, polyethylene and polypropylene.

9. The safety glass container of claim 1, wherein said protective film sheath has a thickness of 0.05 to 0.1 mm.

10. The safety glass container of claim 1, wherein an aventurine area is provided on at least one of the shoulder portion and bottom portion.

11. The safety glass container of claim 1, wherein said cushioning materials are thermoplastic resin monofilaments fitted in grooves formed on the shoulder portion and bottom portion.

12. The safety glass container of claim 1, wherein said protective film sheath is heat-shrunk into contact with a major portion of the side wall and at least a minor portion of the bottom wall.

13. The safety glass container of claim 1, wherein said glass container is an internal pressure glass bottle for carbonated drinks.

14. The safety glass container of claim 1, wherein a small gap is formed between the surface of the container and shrunk film.

15. The safety glass container of claim 14, wherein the small gap is formed by providing a rugged area on the inner surface of the film on or near at least one end thereof.

16. The safety glass container of claim 14, wherein the small gap is formed by an aventurine area on or near at least one of the neck portion and bottom portion.

17. The safety glass container of claim 14, wherein the small gap is formed by intermittent adhesive layers on or near at least one of the neck portion and bottom portion.

* * * * *